US006126001A

United States Patent [19]

McGill

[11] Patent Number: 6,126,001

[45] Date of Patent: Oct. 3, 2000

[54] NESTABLE SECURITY PACKAGE FOR RECORDED MEDIA

[75] Inventor: James A. McGill, Canton, Ohio

[73] Assignee: Alpha Enterprises, Inc., North Canton, Ohio

[21] Appl. No.: 09/184,610

[22] Filed: Nov. 2, 1998

Related U.S. Application Data

[60] Provisional application No. 60/064,499, Nov. 5, 1997.

[51] Int. Cl.[7] ..... B65D 85/57

[52] U.S. Cl. ..... 206/308.2; 206/1.5; 206/505; 206/807

[58] Field of Search ..... 206/308.2, 309, 206/387.1, 387.11, 387.12, 387.13, 1.5, 505, 506, 507, 807; 70/57.1, 63

[56] References Cited

U.S. PATENT DOCUMENTS

| | | | |
|---|---|---|---|
| 767,298 | 8/1904 | Louis . | |
| 971,423 | 9/1910 | Walters . | |
| 3,933,240 | 1/1976 | Humble . | |
| 4,466,540 | 8/1984 | Lotrous et al. . | |
| 4,727,984 | 3/1988 | Bennardo . | |
| 4,966,020 | 10/1990 | Fotheringham et al. . | |
| 5,031,756 | 7/1991 | Buzzard et al. . | |
| 5,147,034 | 9/1992 | Broadhead et al. . | |
| 5,209,086 | 5/1993 | Bruhwiler . | |
| 5,211,283 | 5/1993 | Weisburn et al. . | |
| 5,215,189 | 6/1993 | Weisburn et al. | 206/1.5 |
| 5,289,914 | 3/1994 | Holmgren . | |
| 5,390,515 | 2/1995 | Essick . | |
| 5,524,752 | 6/1996 | Mazzucchelli . | |
| 5,588,315 | 12/1996 | Holmgren . | |
| 5,593,034 | 1/1997 | Zeid | 206/1.5 |
| 5,598,728 | 2/1997 | Lax . | |
| 5,713,461 | 2/1998 | Su . | |
| 5,901,840 | 5/1999 | Nakasuji | 206/308.2 |
| 5,904,246 | 5/1999 | Weisburn et al. | 206/308.2 |
| 5,934,114 | 8/1999 | Weisburn et al. | 206/308.2 |

FOREIGN PATENT DOCUMENTS

WO98/36143 8/1998 WIPO .

*Primary Examiner*—Paul T. Sewell
*Assistant Examiner*—Luan K. Bui
*Attorney, Agent, or Firm*—Sand & Sebolt

[57] ABSTRACT

A nestable security package for a media storage box includes a housing having a hanger end and a compartment. The compartment is formed by a front wall, a pair of spaced, parallel side walls, a rear wall, a bottom wall, and a top flange. These walls are disposed and configured to receive a media storage box. A locking mechanism is provided that may be moved from a locking position to an unlocked position wherein the media storage box is lockingly retained in the compartment when the locking mechanism is in the locked position. The object of the invention is to provide a security package which does not substantially increase the storage footprint depth of the media storage box. This object is achieved by providing wall configurations that allow one security package to nest with an adjacent security package such that the storage footprint depth of the media storage box is only increased by a single wall thickness. This configuration is achieved by providing first, second, third, and fourth cut outs in the housing which are disposed to receive the bottom wall, the top flange, the locking mechanism, and a lock plate. The cut outs are sized to allow adjacent security packages to tilt with respect to each other. The cut outs are also angled to prevent one security package from catching on an adjacent security package.

18 Claims, 5 Drawing Sheets

NESTABLE SECURITY PACKAGE FOR RECORDED MEDIA

CROSS REFERENCE TO RELATED APPLICATION

This application claims the benefit of U.S. Provisional patent application Ser. No. 60/064,499 filed on Nov. 5, 1997.

BACKGROUND OF THE INVENTION

1. Technical Field

The present invention relates generally to reusable security packages for recorded media and, more particularly, to a security package having a lock that prevents unauthorized removal of the media from the package and that may be displayed in a typical display rack. Specifically, the invention relates to a reusable security package that nests with other substantially identical packages so that a higher density of packages may be displayed in a display rack.

2. Background Information

Various types of housings and security packages have been developed to provide a safe and secure device for displaying cassette tapes, compact discs and other media while retarding unauthorized removal of the media from the display package and subsequent theft from a store. Examples of such security packages are shown in U.S. Pat. Nos. 4,760,914, 4,805,769, and 5,211,283. Compact discs generally are retained within a plastic box commonly referred to as a "jewel box" to protect the disc from damage and to provide a protective storage container for the disc when it is not in use. Other items of recorded media are stored in similar protective boxes. It is desirable that these storage boxes be retained in the larger security package for display to hamper theft.

Storage boxes are usually formed from a clear plastic material and typically contain paper or cardboard cards that have various printed indicia on one side thereof to indicate the contents of the recording. It is desirable that these graphics be properly oriented when the storage box is retained in a security package so that customers when looking through a storage rack containing a plurality of such packages, will always have the graphics presented in the correct orientation for ease of reading to facilitate the sale of the recording.

One problem with the security packages currently available to store owners is that the security package increases the overall storage footprint of the storage box when the box is secured in the security package. The storage footprint for a storage box is defined by the width and depth of the box because the boxes are almost always displayed on end. The increased storage footprint of the security package requires the store owner to use more shelf space to display the recordings. Added shelf space increases the costs to the store owner. It is thus desired in the art to provide a security package for an item of recorded media such as a compact disc that minimizes the required shelf space for displaying the recorded media.

Another problem associated with the display of recorded media in security packages is that it is highly desirable that the customer be able to view the front of the package while it is displayed on a shelf. When a store owner completely fills a display shelf with recorded media, it is often not possible for the customer to easily flip through the selections and view the fronts of the storage boxes without completely removing the security package and storage box from the display shelf. It is thus desired in the art to provide a security package that saves shelf space while also allowing customers to view the fronts of the storage boxes while retained in the security packages.

Although seemingly insignificant, the larger storage footprint of a security package occupies large amounts of space when repeated on thousands of items of recorded media. For instance, 58 plain CD jewel boxes will fit into a 24" display shelf without employing a security device. Thus, approximately 350' of shelf space is required to display approximately 10,000 jewel boxes. When the store owner places the jewel boxes in security packages to reduce theft, the same 10,000 jewel boxes require approximately 465' of display space. Thus, the security package increases the shelf space by 33%. It can thus be understood that a security package that minimizes shelf space is highly desired in the art.

SUMMARY OF THE INVENTION

Objectives of the invention include providing a nestable security package for recorded media capable of lockingly receiving an item of recorded media and lockingly retaining the item until being released with a key.

Another object of the present invention includes providing a nestable security package for recorded media having retaining members sufficiently strong to prevent unauthorized removal of the item of recorded media from the security package.

A further object of the present invention includes providing a nestable security package for recorded media having a substantially smaller storage footprint than those security packages known in the art.

Still another object of the present invention includes providing a nestable security package for recorded media having a configuration that allows the front and rear surface of the item of recorded media to be viewed when the item of recorded media is lockingly received in the security package.

Yet another object of the present invention includes providing a nestable security package for recorded media wherein a locking mechanism known in the art may be employed without significant modification.

A further object of the present invention includes providing a nestable security package for recorded media having a configuration that allows the front surface of the security package to nest with the rear surface of a next adjacent security package to decrease the shelf space occupied by the security package.

Another object of the present invention includes providing a nestable security package for recorded media having a configuration that permits the security packages to tilt with respect to each other while in a nested condition.

A further object of the present invention includes providing a nestable security package for recorded media having a configuration that enables the package to be easily removed from two other nested packages.

These and other objects and advantages of the invention are obtained by a security device for lockingly holding a media storage box having a storage footprint depth equal to the thickness of the media storage box, the security device including a housing having a compartment that is adapted to receive the media storage box; the housing having a plurality of retaining members adjacent the compartment, the retaining members adapted to hold the media storage box in the compartment; each of the retaining members having a thickness; the retaining members being arranged such that the storage footprint depth of the security package is only greater than the storage footprint depth of the media box by the thickness of one of the retaining members.

Other objects and advantages of the invention are obtained by a combination of a pair of security devices each for lockingly holding a media storage box having a storage footprint depth equal to the thickness of the media storage box, each of the security devices including a housing having a compartment that is adapted to receive the media storage box; the housing having a plurality of retaining members adjacent the compartment, the retaining members adapted to hold the media storage box in the compartment; and each of the retaining members having a thickness; the security devices nested together such that the storage footprint depth of the security devices is only greater than the storage footprint depths of the media boxes by the thickness of two of the retaining members.

BRIEF DESCRIPTION OF THE DRAWING

The preferred embodiment of the invention, illustrative of the best mode in which applicant has contemplated applying the principles of the invention, is set forth in the following description and is shown in the drawings and is particularly and distinctly pointed out and set forth in the appended claims.

Similar numbers refer to similar elements through the specification.

DESCRIPTION OF THE PREFERRED EMBODIMENT

Figure 1:
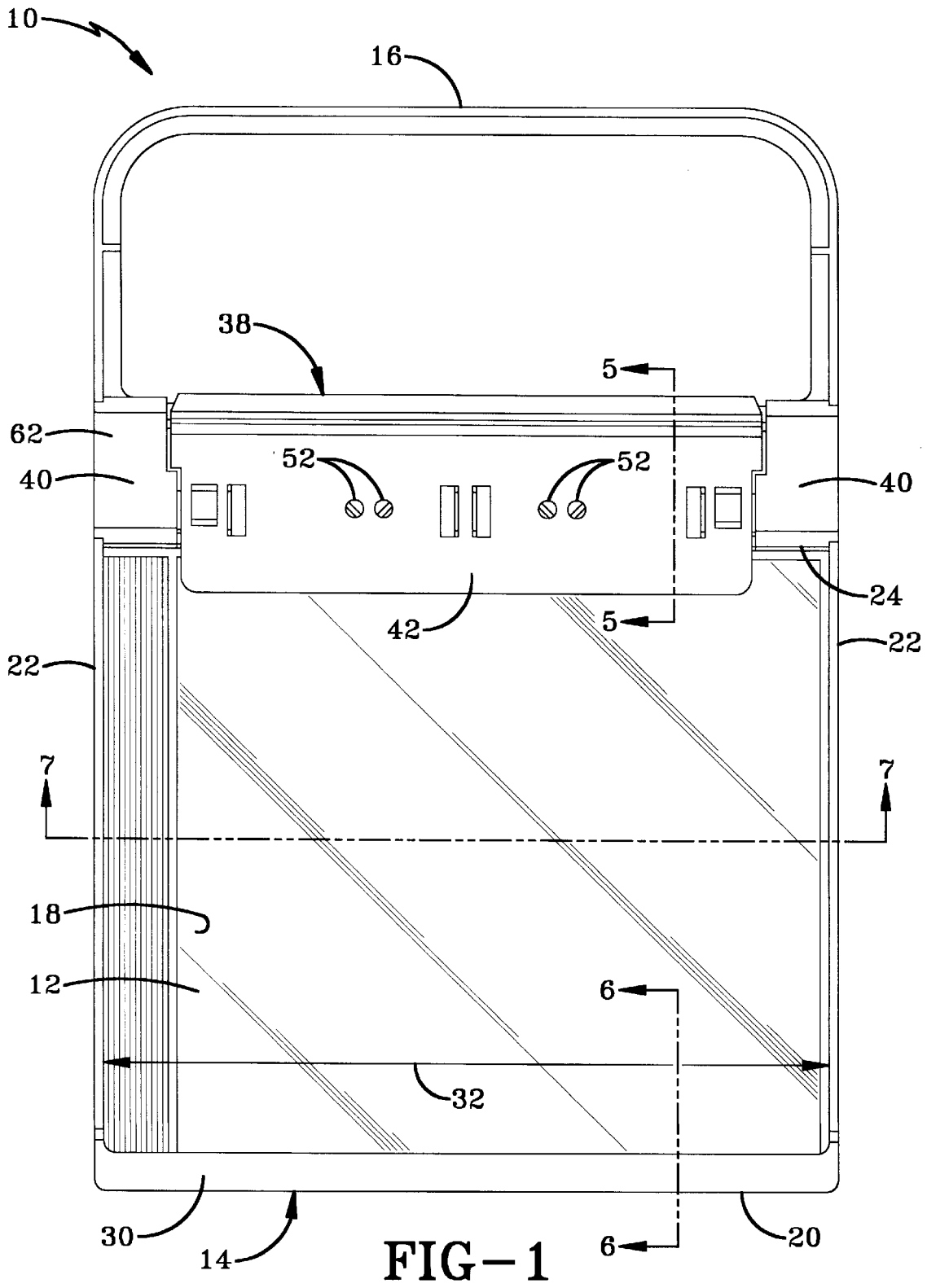
FIG. 1 is a top plan view of the nestable security package holding an item of recorded media in a locked position.

A nestable security package for recorded media according to the present invention is indicated generally by the numeral 10 in the accompanying drawings. Security package 10 stores a typical media storage box 12 of the type shown in the Figures for retail store display of the media storage box and to prevent unauthorized removal of the box from the retail store. In the embodiment of the invention depicted in the drawings, security package 10 is depicted as being used to lockingly retain a compact disc storage box or jewel box 12 that typically holds a compact disc. It may be understood that the present invention contemplates providing a security package that may be used with other forms of recorded media such as DVD's, digital cassettes, analog cassettes, game cartridges, computer software, and the like, and that the concepts of the present invention are not to be limited to a security package that is designed to hold jewel boxes.

Security package 10 is formed as a one-piece molded plastic unit preferably molded of high impact polypropylene or other suitable moldable plastic. Security package 10 includes a housing, indicated generally at 14, having a generally rectangular shape, and having a hanger end 16 formed on the opposite end of a storage compartment 18. Compartment 18 is formed by a front wall 20, a pair of spaced, substantially parallel side walls 22, a rear wall 24, and a bottom wall 26. A generally rectangular-shaped opening 28 is formed in bottom wall 26 to enable the display graphics on a storage box 12 to be easily seen therethrough. A top flange 30 projects inwardly from the top of front wall 20 and serves as a retaining lip for the front upper edge of media storage box 12 when it is held in storage compartment 18. A front access opening 32 provides sufficient space between side walls 22, front wall 20, and rear wall 24 for storage box 12 to be inserted into security package 10.

Figure 8:
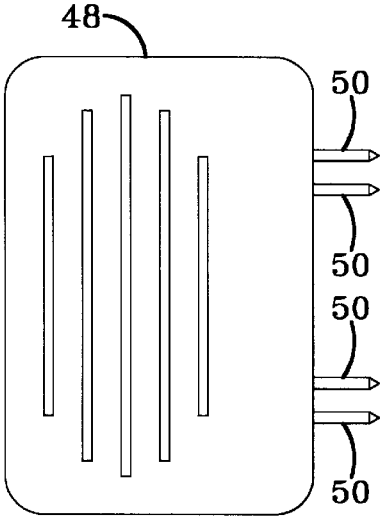
FIG-8 PRIOR ART
FIG. 8 is a plan view of a prior art key configured to unlock the security package depicted in FIGS. 1 through 7.

A locking mechanism 38 is carried between two shoulders 40 on side walls 22 to lockingly retain storage box 12 in security package 10 when in the locked position as depicted in the figures. In the locked position, a lock plate 42 extends over the front face of storage box 12 to retain box 12 between bottom wall 26, top flange 30, and lock plate 42. Storage box 12 cannot be removed from security package 10 when lock plate 42 is in the locked position without significantly damaging security package 10. Lock plate 42 is hinged to a rear support 44 by a hinge member 46. Locking mechanism 38 includes a plurality of locking projections that engage corresponding projections on lock plate 42 to lockingly retain lock plate 42 in the locked position until it is released with a key 48. A prior art key 48 is depicted in FIG. 8 and may be used unlock locking mechanism 40 when the tangs 50 of key 48 are inserted into the corresponding openings 52 in locking mechanism 38. Tangs 50 engage the locking projections and move them to an unlocked position to allow lock plate 42 to be pivoted upwardly and rearwardly away from front access opening 32 so that storage box 12 may be removed from security package 10. The locking projections and corresponding projections are known in the art and may be seen in detail in U.S. Pat. No. 4,834,238, which is incorporated herein by reference.

It may thus now be understood that the retaining members (top flange 30, bottom wall 26, and lock plate 42) of security package 10 must be disposed over both the front and rear surfaces of storage box 12 so that security package 10 can lockingly retain storage box 12. As such, the use of security package 10 necessarily increases the storage footprint depth of storage box 12. In the past, the storage footprint depth of storage box 12 was increased by two thicknesses of the retaining members. In accordance with one of the primary objects of the present invention, security package 10 of the present invention only increases the storage footprint depth of storage box 12 by a single retaining member thickness. Security package 10 of the present invention only increases the footprint depth of storage box 12 because its rear surface 60 is configured to nest with the front surface 62 of an adjacent, substantially identical security package 10 as shown in FIGS. 4–7. This nesting configuration allows security package 10 to retain all of the locking functions of prior art security packages while significantly decreasing the storage footprint depth.

Each of the retaining members (top flange 30, bottom wall 26, and lock plate 42) has a thickness large enough to provide adequate strength to the retaining members without unduly increasing the expense or the bulk of security package 10. In accordance with one of the objects of the invention, the retaining members are disposed and configured such that adjacent security devices 10 may nest together as depicted in FIGS. 4–7. Storage box 12 has a storage footprint depth equal to its depth, generally indicated by dimension line 64 when stored without security package 10. The nesting configuration of security package 10 of the present invention allows storage boxes 12 to be displayed in security packages 10 while only increasing their storage footprint depth by the thickness of a single retaining member indicated generally by dimension line 66. In the prior art, a security package increased the storage footprint depth by at least two thicknesses of the retaining members. The nesting configuration of security package 10 of the present invention thus substantially decreases the required storage and display space for the items of recorded media.

The nesting configuration is achieved by providing housing 14 with a plurality of notches or cut outs that are disposed to receive the retaining members when two security packages are adjacently disposed. More specifically, housing 14 is provided with first cut outs 70 in front surface 62, and second 72, third 74, and fourth 76 cut outs in rear surface 60.

Figure 4:
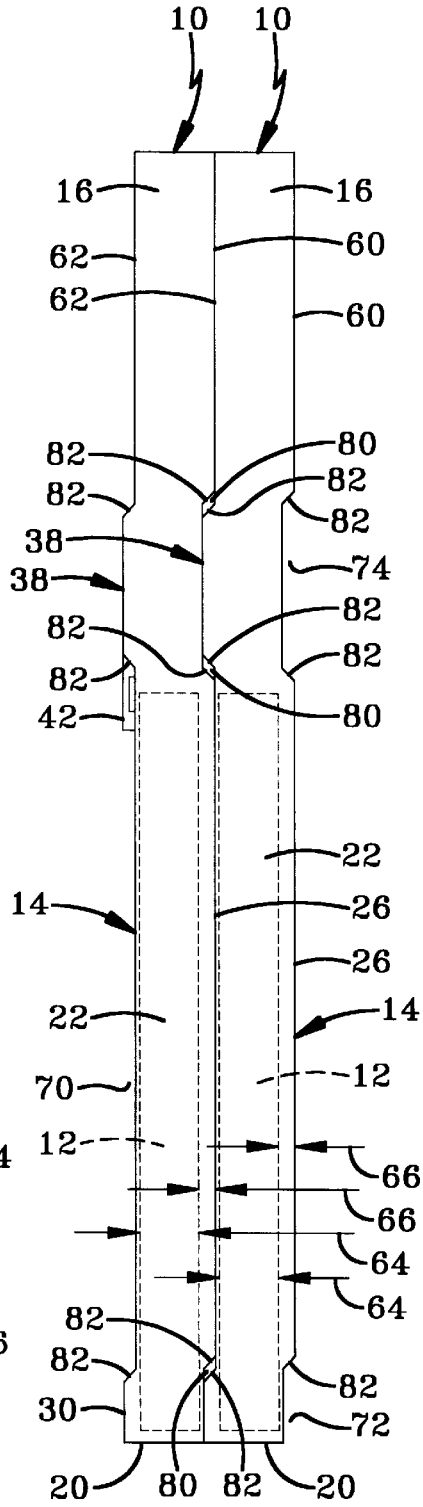
FIG. 4 is a side view of a pair of the security packages nested together.

First cut out 70 is achieved by notching the tops of side walls 22 between top flange 30 and locking mechanism 38 to a depth substantially equal to the thickness 66 of one retaining member. As may be seen in FIG. 4, the length of each cut out 70 is somewhat greater than the length of bottom wall 26. Cut outs 70 receive bottom wall 26 when two adjacent security packages 10 are nested together as shown in FIG. 4. Although cut out 70 reduces the thickness of sidewalls 22, sidewalls 22 are sufficiently dimensioned to provide adequate strength to security package 10 to prevent unauthorized removal of storage box 12 from package 10.

Second cut out 72 is formed by notching the bottoms of side walls 22 to a depth substantially to the thickness 66 of a retaining member. Second cut out 72 is formed in the forward portion of rear surface 60 of housing 14. Second cut out 72 is configured to receive top flange 30 when two security packages 10 are nested together. As may be seen in FIGS. 4 and 6, second cut out 72 is somewhat longer than the length of top flange 30. Again, the removal of the material to form second cut out 72 does not substantially degrade the strength of security package 10.

Figure 2:
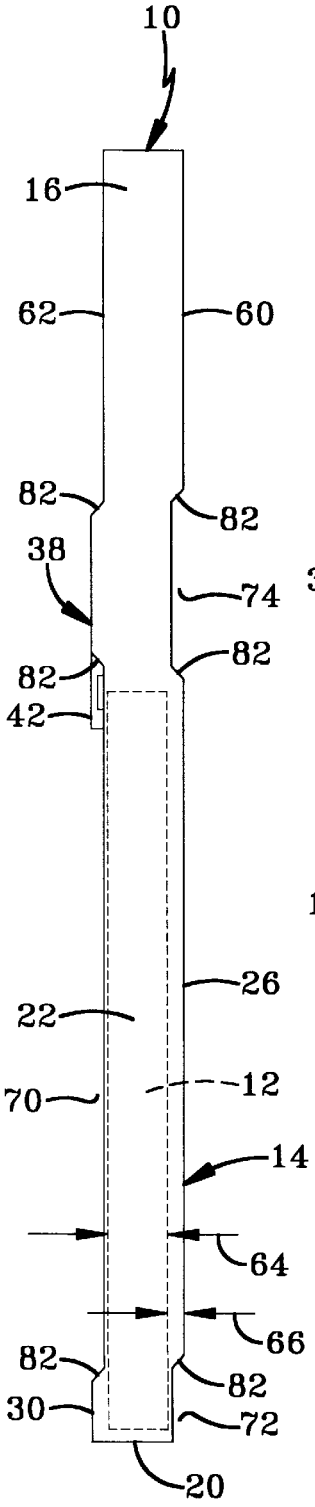
FIG. 2 is a side view of the nestable security package.

Third cut out 74 is formed by notching the bottoms of side walls 22 behind locking mechanism 38 as shown in FIG. 2. The depth of third cut out 74 is substantially equal to the thickness of a retaining member and is specifically formed to receive locking mechanism 38 when two security packages 10 are nested together. As may been seen in FIG. 4, the length of third cut out 74 is somewhat larger than the length of locking mechanism 38.

Figure 3:
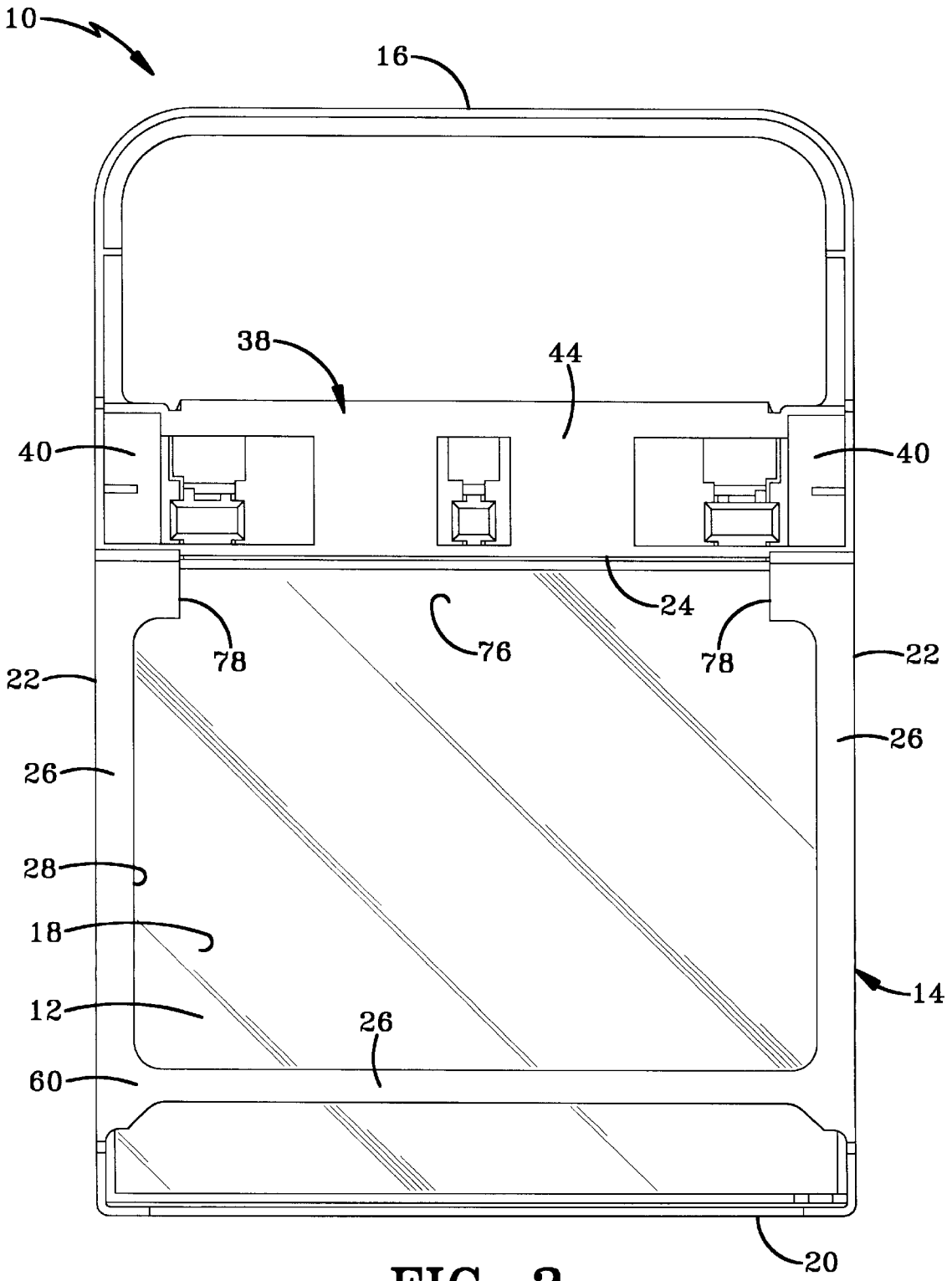
FIG. 3 is a bottom plan view of the nestable security package holding an item of recorded media in a locked position.
Figure 6:
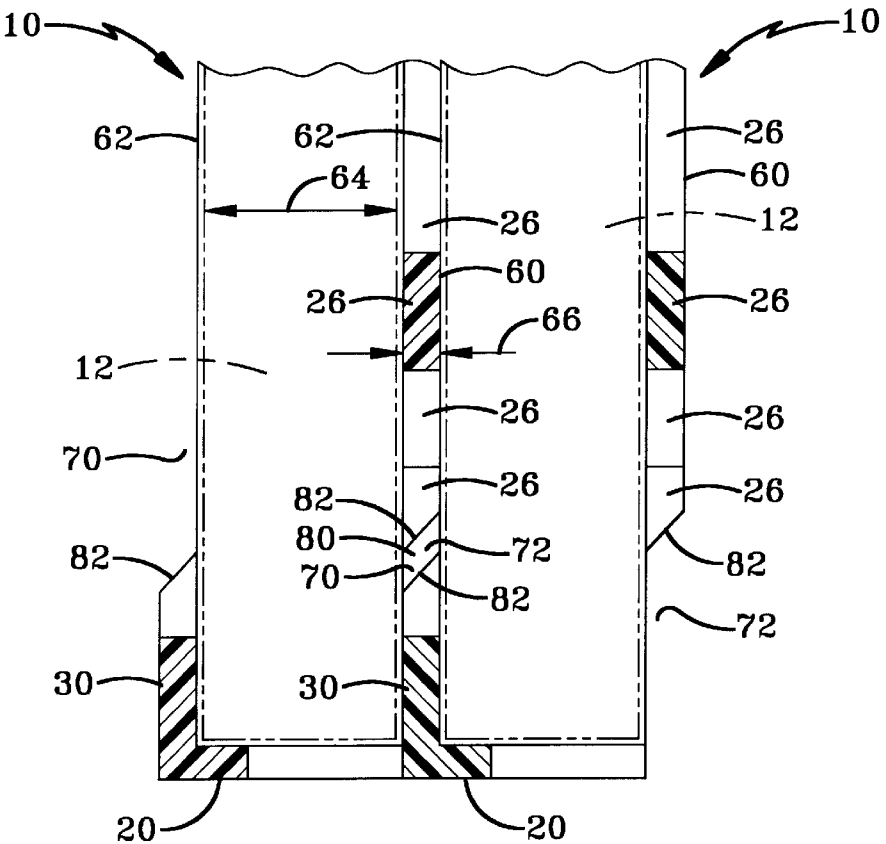
FIG. 6 is a sectional view taken along line 6—6 of FIG. 1.
Figure 5:
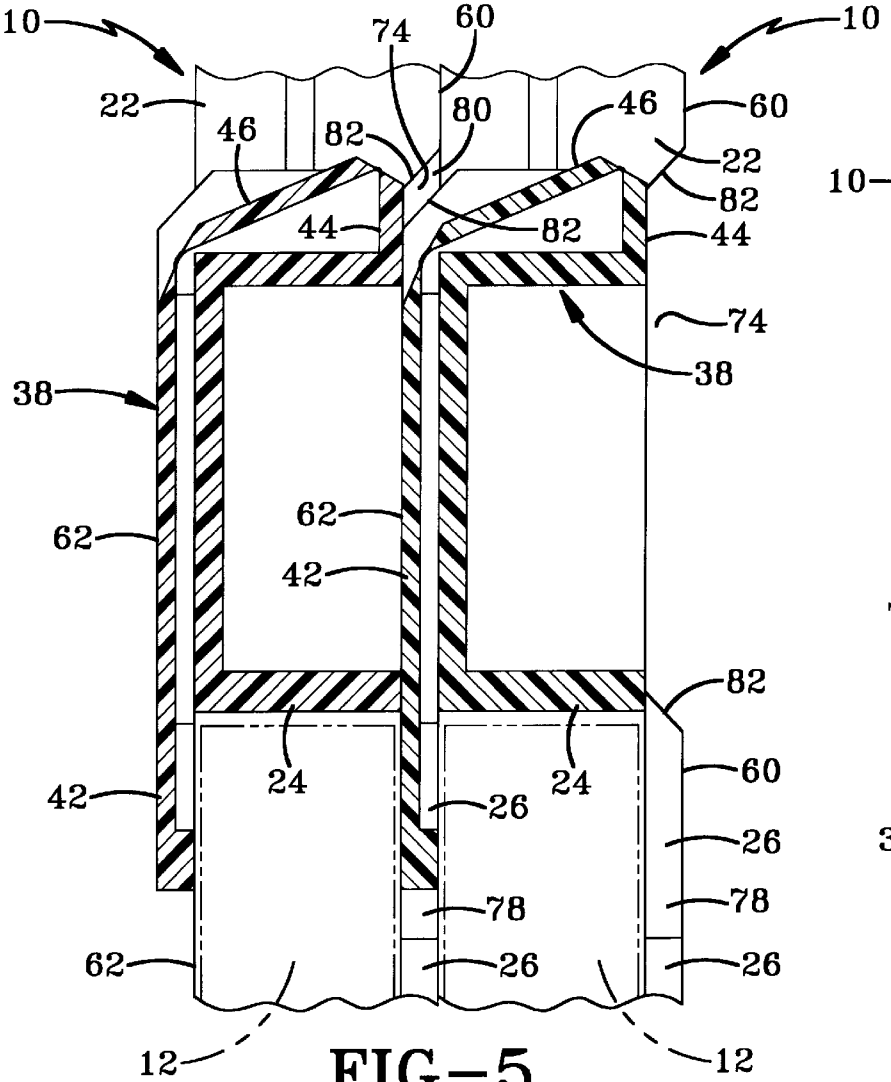
FIG. 5 is a sectional view taken along line 5—5 of FIG. 1.
Figure 7:
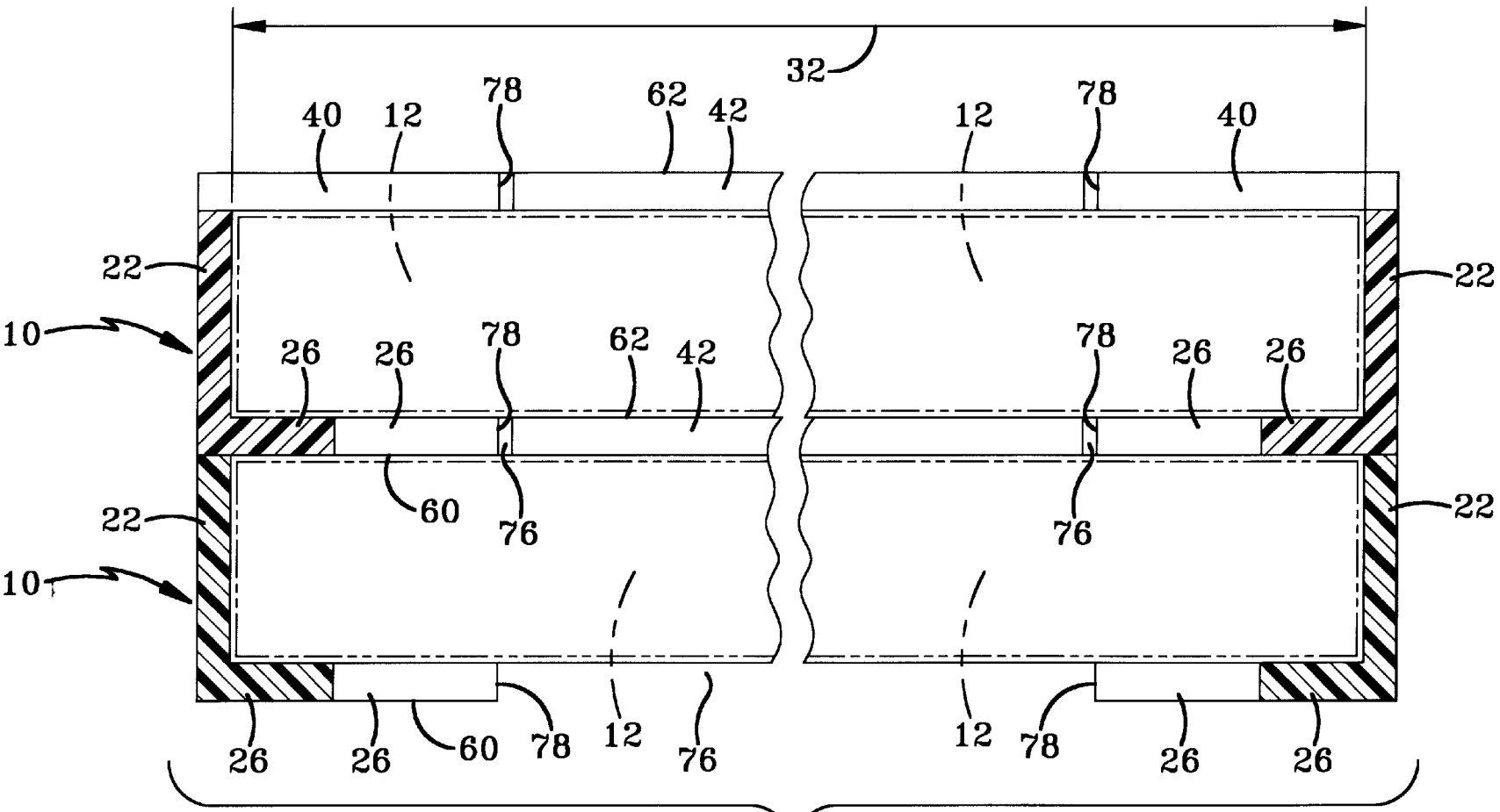
FIG. 7 is a sectional view taken along line 7—7 of FIG. 1.

Fourth cut out 76 is formed by removing material from bottom wall 26 in the area adjacent rear wall 24 at a width to receive lock plate 42 when two adjacent security packages 10 are nested together. Fourth cut out 76 may be to perhaps most clearly seen in FIG. 3 where it extends between the two ends 78 of bottom wall 26. The proper depth of fourth cut out 76 is automatically achieved because the thickness of bottom wall 26 is substantially equal to the thickness of lock plate 42.

The use of the nesting configuration achieved by cut outs 70, 72, 74, and 76 significantly increases the number of security packages 10 that may fit onto a fixed amount of shelf space. For example, only 39 security packages 10 will fit onto a 24" shelf prior to removing the material out at cut outs 70, 72, 74, and 76. The nesting configuration of the present invention allows 53 security packages 10 to fit into the same 24" shelf space. This is over a 35% increase in density achieved by the nesting configuration. Such an increase in density can significantly lower the display costs to large retailers.

As discussed above, cut outs 70, 72, and 74 are somewhat longer than the retaining elements which are received in the cut outs. Such dimensioning creates gaps, indicated generally by the numeral 80, between retaining elements when security packages 10 are nested together. Gaps 80 allow adjacent security packages 10 to be slid or tilted with respect to each other while in the nested configuration. This slight tilting provides the customer easier access to storage boxes 12 when a substantial number of security packages 10 are displayed together. It may also be seen in the figures that each cut out 70, 72, and 74 has an angled end as indicated generally by the numeral 82. Angled ends 82 of cut outs 70, 72, and 74 prevent one security package 10 from catching on an adjacent, nested security package 10 when a customer desires to remove security package 10 from a display shelf.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the nestable security package is construed and used, the characteristics of the construction, and the advantages, new and useful results obtained, the new and useful structures, devices, elements, arrangements, parts and combinations, are set forth in the appended claims.

What is claimed is:

1. A security device for selectively lockingly holding a media storage box; the media storage box having a thickness and a storage footprint depth equal to the thickness of the media storage box; said security device comprising:

a housing having a compartment adapted to receive the media storage box;

said housing having a plurality of retaining members adjacent said compartment, said retaining members adapted to selectively hold the media storage box in said compartment;

each of said retaining members having a thickness;

said retaining members being arranged about said housing such that the storage footprint depth of the housing is greater than the storage footprint depth of the media storage box by a thickness of only one of said retaining members;

said retaining members including a top flange having a thickness, a bottom wall having a thickness and a length, and a lock plate having a thickness;

said lock plate being disposed substantially parallel to said bottom wall;

said top flange being parallel to said bottom wall; and said lock plate being coplanar with said top flange.

2. The security device of claim 1, wherein said housing includes a pair of sidewalls, each of said sidewalls having a top and a bottom, said housing further including a first cut out in said top of each of said sidewalls, each of said first cut outs having a depth substantially equal to said thickness of said bottom wall; said first cut outs being disposed on the opposite side of said housing than said bottom wall.

3. The security device of claim 2, wherein each of said first cut outs is longer than said bottom wall.

4. The security device of claim 3, wherein each of said first cut outs includes angled ends.

5. The security device of claim 1, wherein said housing includes a pair of sidewalls, each of said sidewalls having a top and a bottom, said housing further including a second cut out in said bottom of each of said sidewalls, each of said second cut outs having a depth substantially equal to said thickness of said top flange; said second cut outs being disposed on the opposite side of said housing than said top flange.

6. The security device of claim 5, wherein each of said second cut outs is longer than said top flange.

7. The security device of claim 6, wherein each of said second cut outs includes angled ends.

8. The security device of claim 1, wherein at least one of said retaining members is a lock plate that may be moved from a locked position covering at least a portion of the compartment wherein the storage box may not be removed from the compartment and an unlocked position where the storage box may be removed from the compartment.

9. The security device of claim 8, further comprising a locking mechanism carried by said housing, said locking mechanism selectively lockingly retaining said lock plate in said locked position.

10. The security device of claim 9, further comprising a key adapted to cooperate with said locking mechanism to release said locking plate from said locked position.

11. The security device of claim 1, wherein said retaining members include a bottom wall and a lock plate; a fourth cut out in said bottom wall; said fourth cut out being disposed on the opposite side of said housing than said lock plate.

12. The security device of claim 11, wherein said fourth cut out is wider than said lock plate.

13. A security device for selectively lockingly holding a media storage box; the media storage box having a thickness and a storage footprint depth equal to the thickness of the media storage box; said security device comprising:

a housing having a compartment adapted to receive the media storage box;

said housing having a plurality of retaining members adjacent said compartment, said retaining members adapted to selectively hold the media storage box in said compartment;

each of said retaining members having a thickness;

said retaining members being arranged about said housing such that the storage footprint depth of the housing is greater than the storage footprint depth of the media storage box by the thickness of only one of said retaining members;

at least one of said retaining members being a lock plate that may be moved from a locked position covering at least a portion of the compartment wherein the storage box may not be removed from the compartment and an unlocked position where the storage box may be removed from the compartment;

a locking mechanism carried by said housing, said locking mechanism selectively lockingly retaining said lock plate in said locked position; and said housing including a pair of sidewalls, each of said sidewalls having a top and a bottom, said housing further including a third cut out in said bottom of each of said sidewalls, each of said third cut outs having a depth substantially equal to the thickness of said lock plate; said third cut outs being disposed on the opposite side of said housing than said locking mechanism.

14. The security device of claim 13, wherein each of said third cut outs is longer than said locking mechanism.

15. The security device of claim 14, wherein each of said third cut outs includes angled ends.

16. In combination, a pair of security devices; each security device for selectively lockingly holding a media storage box having a thickness; each media storage box having a storage footprint depth equal to the thickness of the media storage box; each of said security devices including:

a housing having a compartment adapted to receive the media storage box;

said housing having a plurality of retaining members adjacent said compartment, said retaining members adapted to selectively hold the media storage box in said compartment;

each of said retaining members having a thickness;

said retaining members being arranged about the housing to allow said security devices to nest together such that the storage footprint depth of both housings is greater than the storage footprint depths of the media boxes by the thickness of only two of said retaining members; and said retaining members including top flanges, bottom walls, and lock plates; each of said housings including cut outs to receive said retaining members when said security devices are nested together;

said lock plates of said security devices being substantially parallel to said bottom walls;

said top flanges being parallel to said bottom walls; and each lock plate being coplanar with one top flange.

17. The combination of claim 16, wherein each of said housings includes a pair of sidewalls having a top and a bottom;

each of said sidewalls having a first cut out in said top of said sidewall, said first cut outs of one of said security devices receiving said bottom wall of another of said security devices when said security devices are nested together;

each of said sidewalls having a second cut out in said bottom of said sidewall, said second cut outs of one of said security devices receiving said top flange of another of said security devices when said security devices are nested together.

18. The combination of claim 17, wherein each of said security devices includes a locking mechanism;

each of said sidewalls having a third cut out in said bottom of said sidewall, said third cut outs of one of said security devices receiving said locking mechanism of another of said security devices when said security devices are nested together;

each of said bottom walls having a fourth cut out, said fourth cut out of one of said security devices receiving said lock plate of another of said security devices when said security devices are nested together.

* * * * *